US007312579B2

(12) United States Patent
Zhurin

(10) Patent No.: US 7,312,579 B2
(45) Date of Patent: Dec. 25, 2007

(54) HALL-CURRENT ION SOURCE FOR ION BEAMS OF LOW AND HIGH ENERGY FOR TECHNOLOGICAL APPLICATIONS

(75) Inventor: Viacheslav V. Zhurin, Fort Collins, CO (US)

(73) Assignee: Colorado Advanced Technology LLC, Fort Collins, CO (US)

( * ) Notice: Subject to any disclaimer, the term of this patent is extended or adjusted under 35 U.S.C. 154(b) by 0 days.

(21) Appl. No.: 11/405,719

(22) Filed: Apr. 18, 2006

(65) Prior Publication Data

US 2007/0241290 A1 Oct. 18, 2007

(51) Int. Cl.
*H01J 7/24* (2006.01)

(52) U.S. Cl. ..... 315/111.41; 315/111.21; 315/111.81; 250/423 R

(58) Field of Classification Search ..... 315/111.21–111.91; 250/423 R, 423 F, 427; 118/723 R, 723 MR, 723 MA, 621, 623, 118/639; 313/359.1, 361.1, 362; 156/345.42, 156/345.46

See application file for complete search history.

(56) References Cited

U.S. PATENT DOCUMENTS 4,862,032 A 8/1989 Kaufman et al.
5,274,306 A * 12/1993 Kaufman et al. ..... 315/111.41
5,315,121 A * 5/1994 Kluge et al. ..... 250/423 R
6,456,011 B1 * 9/2002 Bugrova et al. ..... 315/111.91
6,645,301 B2 11/2003 Sainty
6,750,600 B2 6/2004 Kaufman et al.
6,870,164 B1 * 3/2005 Baldwin et al. ..... 250/423 R
6,963,162 B1 11/2005 Centurioni
7,023,128 B2 * 4/2006 Madocks ..... 313/359.1
2003/0193295 A1 * 10/2003 Kaufman et al. ..... 315/111.81
2004/0195521 A1 * 10/2004 Alekseev et al. ..... 250/423 R
2004/0217713 A1 * 11/2004 Madocks ..... 315/111.41
2005/0237000 A1 10/2005 Zhurin
2006/0152162 A1 * 7/2006 Madocks ..... 315/111.21

* cited by examiner

*Primary Examiner*—Haissa Philogene
*Assistant Examiner*—Tung X Le

(57) ABSTRACT

A Hall-current ion source for generation of low and high energy ion beams with selection of magnetic fields and emission currents, where there are utilized low magnetic fields and high emission currents that are higher than discharge currents for low energy ion beams, 15-100 eV; high magnetic fields and emission currents that are equal to discharge currents are utilized for discharge voltages providing ion beam energies of 100-500 eV. Other measures are utilized for protection of a gas distribution area and a magnet from pinching by an ion beam penetration through a reflector by a buffer chamber providing better gas distribution in anode area, a protective ring in a center part of a reflector, and others.

3 Claims, 10 Drawing Sheets

HALL-CURRENT ION SOURCE FOR ION BEAMS OF LOW AND HIGH ENERGY FOR TECHNOLOGICAL APPLICATIONS

BACKGROUND OF THE INVENTION

1. Field of the Invention

This invention relates in general to the technology of ion and plasma sources, and more particularly to a Hall-current ion source designed for producing broad ion beams of various energies utilized in thin film technology and material processing.

2. Description of the Prior Art

A Hall-current ion source, in some cases also called end-Hall ion source, was described in U.S. Pat. No. 4,862,032 by Kaufman et al. Later it was modified in U.S. Pat. No. 6,608,431 by Kaufman as an ion source of a modular design for easy assembly/disassembly. A very similar concept of a Hall-current ion source was described in a U.S. Pat. No. 6,645,301 by Sainty. Varieties of another Hall-current ion source type called as closed drift ion sources in a form of electric propulsion thrusters and ion sources are known and described by Zhurin et al in article "*Physics of Closed Drift Thrusters*" in *Plasma Sources Science & Technology,* Vol. 8 (1999), beginning on page R1. A hybrid ion source of end-Hall type and closed drift ion source is presented in U.S. Pat. No. 7,116,054 by Zhurin.

This ion source utilizes features of both types of ion sources and provides more efficient ionization and acceleration of ion beam than regular end-Hall ion source. In this ion source, in comparison with Kaufman et al. and Sainty's end-Hall ion sources having magnetic field with reducing its strength from a gas distributing system to a discharge channel exit, there is utilized a positive gradient of magnetic field in a discharge channel for efficient acceleration of ions and for suppression of high amplitude discharge current and voltage oscillations. These publications are incorporated herein by reference. A Hall-current ion source belongs to a family of gridless ion sources and was introduced together with a gridded ion source for industrial applications. Description of gridded ion source for technological applications was given by Kaufman in article "*Technology of Ion Beam Sources Used in Sputtering*", in *Journal of Vacuum Science & Technology*, Vol. 15, pp 272-276, March/April 1978. This publication is also incorporated herein by reference. All these ion sources are spin-offs from electric propulsion thrusters utilized with space satellites for producing thrust to move satellite with a certain momentum to a designated position in space.

If gridded ion sources can be considered as electrostatic ion sources, then gridless ion sources can be called electromagnetic ion sources. Operation of all Hall-current ion sources is based on electrical discharge in gas in magnetic field at pressures of about $10^{-5}$-$10^{-3}$ Torr with reduced mobility of electrons in direction across to magnetic field lines. Because of this, it becomes possible in a direction of magnetic field lines to develop quite strong electric field strength that provides acceleration of ions.

In order to maintain electrical discharge in gas it is necessary to utilize conditions, which include presence of charged particles that depend on magnetic field value and its geometry, shape of electrodes and other factors influencing charge transportation in plasma. It can lead to a separation of charge particles caused by different trajectories and velocities of ions and electrons. Such separation generates a Hall current, which is directed along a normal to vectors of discharge current, I and magnetic field, B.

Hall current plays a major role in ion acceleration in plasma when a characteristic time of a process is an order of a period of charged particles rotation along a Larmour radius $\tau \geqq 1/\omega_i$ with a condition that an electron component becomes "magnetized". "Magnetized" plasma means that both electron and ion components of plasma experience many revolutions around a magnetic field line before they move due to a collision with a neighbor particle. However, it is not necessary that both plasma components will be magnetized. In the case of ion sources, only electrons are usually "magnetized" and ions are not magnetized.

It is important that for a Hall-current ion source there will be performed the following condition: $r_{Le} << l << r_{Li}$, where l is a characteristic dimension of acceleration zone of a discharge region (length or width of a discharge channel), $r_{Le}$ and $r_{Li}$ are Larmour radii, correspondingly for electrons and ions.

Electrons drift along equipotential surfaces, which are presented by magnetic field lines, and ions are accelerated in a direction of electrical field practically without any influence of magnetic field, because they are not magnetized as electrons. Electrons in existing Hall-current ion sources invented by Kaufman et al. and Sainty have strong axial magnetic field component, $B_z$ in area of a gas distributing system and a hollow anode bottom part, and only close to exit from a discharge chamber magnetic field lines acquire a substantial value of radial magnetic field component, $B_r$. The features of low value of radial component of magnetic field in a gas distributing system and anode area of Hall-current ion sources and influence of axial component on an ion beam current value were discussed in detail by Zhurin et al. in the above mentioned article "*Physics of Closed Drift Thrusters*" in *Plasma Sources Science & Technology*, Vol. 8 (1999), beginning on page R1 and by Zhurin in US 2005/0237000 A1.

Regular Hall-current ion sources, in some cases called end-Hall ion sources, fabricated by Veeco Instruments through a license from Kaufman & Robinson Inc., by Kaufman & Robinson Inc. and Saintech Ltd operate with working reactive gases such as Oxygen, Nitrogen, and noble gases such as Argon, Xenon and other gases at discharge voltages, of about $V_d$=100-300 V ($O_2$, $N_2$), and $V_d$=80-300 V (Ar, Xe), and discharge currents from about $I_d$=1 A up to 10-15 A. For most thin film deposition processes including a so-called ion assisted deposition and a sputtering deposition, it is necessary to have energies of ions in the range of 10-30 eV for ion assisted deposition, and in the range of 100-500 eV for a sputtering deposition. An ion beam mean energy of end-Hall ion sources in general is about 60% of discharge voltage, $V_d$. In other words, in order to have a range of mean ion energies from 15 to 500 eV an ion source should operate at discharge voltages from about 25 V to 830 V.

In a publication "Low-Energy End-Hall Ion Source Characterization at Millitorr Pressures" by Kahn et al., SVC (Society of Vacuum Coaters) 48$^{th}$ Annual Technical Conference Proceedings, p 445, 2005, there is presented an end-Hall an ion source EH-1000 with a modified anode that is designed to sustain oxidizing effects on anode performance. This publication is incorporated here by reference. This end-Hall ion source generates ion beams of low energy of about 25 eV with Argon as working gas, where discharge current is 10 A and discharge voltage is 41-43 V. In this case, the operation of ion source with an ion beam of low energies is realized by a high mass flow of working gas, so a background pressure in a vacuum chamber is about 1-2 mTorr. At such high gas pressures in a vacuum chamber a role of charge-exchange mechanisms becomes very important, in the way that ion beam particles-ions exchange energy and momentum with neutrals that become neutrals of high energy and a target receives a flow of energetic neutrals instead of ions. The charge-exchange mechanism plays especially important role at low energies of ions. Resonance charge exchange (on atoms of the same gas) cross section in such conditions is quite high: $\sigma_{ch\text{-}ex} \approx 0.5\times10^{-14}\text{-}10^{-15}$ cm$^2$. During charge exchange a fast ion becomes a fast atom, and slow atom becomes a slow ion, the whole process makes good quantified reliable results for sputtering quite difficult.

Comparatively recent new technique called a biased target deposition was introduced by Zhurin et al. in article "*Biased Target Deposition*" in *Journal of Vacuum Science & Technology*, A 18(1), January/February 2000, p 37. In this article, a compact end-Hall ion source Mark-1 was used with low energy ions applied to a target at ion energy lower than a sputtering energy threshold. This publication is incorporated here by reference. Low energy ion beam interacts with a negatively biased target of several hundreds of electron volts, and ions are accelerated in a short Debye layer (typically 0.1-1 mm, depending on pressure in vacuum chamber). Such a technique is useful for obtaining very fine thin film depositions that are not contaminated by interaction of a low energy ion beam with a target surrounding, because an ion beam energy is not sufficient to sputter unwanted particles, which are not at a negative high potential. In this case, an ion beam interacts only with target having a negative potential. A Hall-current ion source of low energy ions is good candidate for a biased target deposition technique.

An ion assisted deposition is utilized as additional flow of low energy ions applied on a substrate deposited thin film that provided by a high-energy beam sputtering of a target. Low-energy ions from a secondary ion source help to improve adhesion of applied film, to control its stress, to increase hardness, density and structure, making possible to obtain a preferred crystal orientation of a deposited thin film. Recent trend in ion assisted deposition technique is a utilization of low-energy ion beam under 50 eV, so that an ion assist beam modifies a thin film deposition without its sputtering.

The range of discharge voltages of existing regular end-Hall ion sources at pressures in vacuum chamber of $10^{-5}\text{-}10^{4}$ Torr, $V_d$=80-300 V, is not satisfactory for obtaining low energies for certain thin film processes (lower than 50 eV, and about 15-20 eV) with ion assisted tasks and also is not sufficient to provide high sputtering or etching rates with required optimum energies (300-500 eV).

The most usable in thin film industry end-Hall ion sources such as Mark-2 (at present time, produced by Veeco Instruments) and EH-1000 (at present time, produced by Kaufman & Robinson Inc.) utilize as magnetic means permanent magnets with a magnet's strength of about 1.3-1.5 kG at a magnet's North Pole side. There are no any available publications about a role of magnetic field value and its influence on a range of existing operating discharge voltages of 80-300 V with mean ion energies of about 50-180 eV. If Mark-2 and EH-1000 operate up to 300 V, then Sainty's ST3000 operates up to 225 V.

Since the introduction of end-Hall ion source in 1989 there was not much done in improvement of operation characteristics such as broadening of discharge voltage range of end-Hall ion sources. The introduction of a water-cooled anode helped to use higher discharge currents up to 10-15 A, but with low discharge voltages, not over 150 V. In a patent U.S. Pat. No. 6,750,600 B2 "Hall-Current Ion Source" by Kaufman et al. there was introduced a grooved anode for better operation with reactive gases. This publication is incorporated herein by reference. Anode grooves help to reduce influence of oxidized substances on anode operation, because anode covered with oxide film loses its electrical conductivity and gradually increases designated discharge voltages to high undesirable values at constant discharge current, or gradually reduces discharge current with constant discharge voltage. All these conditions depend on a Power Supply, whether it operates with a constant current, or a constant voltage mode. Anode grooves have areas that will be not covered with oxide film, because these areas will be not "seeing" oxide particles that travel in straight lines from outside of an ion source.

There is nothing much changed in a working gas distributing system of existing Hall-current ion sources. Working gas is applied through holes in a gas distributor (often called reflector) under a hollow anode bottom part. The reflector is placed between anode and a permanent magnet and also serves as a shield between hot ionized plasma consisting of high energy ions and low energy electrons supplied by a cathode made of Hot Filament, or Hollow Cathode; this reflector-shield protects a permanent magnet from overheating and direct impact from plasma. An ion beam that is developed at a discharge channel is "supposed" to flow to an ion source exit, but quite a good part of an ion beam flows into opposite direction, into a reflector's surface. Reflector usually after about 20-25 hours of operation at moderate discharge currents (about 5 A and over) and regularly used "optimum discharge voltages", $V_d$=100-150 V (end-Hall Mark-2 and EH-1000 have a maximum ion beam current value at about $V_d$=100-125 V, and Oxygen's ion beam current is higher than Argon's ion beam current by about 20% at the same discharge current and voltage) becomes sputtered in a center part and eventually eroded into quite a substantial hole, so it is necessary to substitute such reflector for a new one.

Some users of end-Hall ion sources that understand the problem of a reflector's sputtering are trying to reduce this damage with theirs own means, or to make reflector's substitution easier and convenient. One of recently approved U.S. Pat. No. 6,963,162 B1 "Gas Distributor for an Ion Source" by Centurioni describes substitution of a reflector's eroded part with an insert of about 1.8 cm in diameter that can be placed in a central part of a reflector. After a certain time of operation this insert is substituted for a new one through an ion source top with tweezers, or similar instrument. Such substitution certainly makes sense, especially if one wants to utilize a reflector's central eroded part with an expensive material such as Tantalum, or Molybdenum-Rhenium, etc. However, the manipulation presented in a Centurioni's patent does not reduce erosion of a reflector, and a reflector's erosion problem remains unsolved. A Centurioni's patent publication is incorporated herein by reference.

There are other problems with regular end-Hall ion sources such as a high level of discharge current and voltage oscillations at higher discharge voltages over, $V_d \geqq 250$ V and a low efficiency of transformation of a discharge current into an ion beam current. This problem was discussed in U.S. Pat. No. 7,116,054 "High-Efficient Ion Source with Improved Magnetic Field" by Zhurin in a hybrid Hall-current ion source that has both features of end-Hall and closed drift ion sources.

There are no quantified values for magnetic field in end-Hall ion sources that could help to select the correct optimum magnetic field value for certain operation conditions and discharge voltage ranges (energies) utilized in technological processes requiring necessary values of ion beam energies and ion beam current densities.

SUMMARY OF THE INVENTION

In a light of foregoing, it is an object of the invention to introduce an ion source of a Hall-current type with improved features, in comparison with existing Hall-current ion sources. Such an ion source with selected ranges of ion beam mean energies provides a broad ion beam of high current. This Hall-current ion source utilizes various values of permanent magnets, or electromagnet's magnetic field for certain ranges of discharge voltages, such as low discharge voltages, which can provide low energies of working gases ions in a range of 15-20 eV, and for high discharge voltages, which can provide high energies of working gases ions in a range of 100-500 eV. Low ion beam ion energies of 15-25 eV are at or under sputtering threshold energies of most materials used in practical applications. In the case of one of the "most popular" working gas such as Argon, a referenced literature gives for various materials the following threshold sputtering energies: Aluminum—13 eV, Titanium—20 eV, Iron—20 eV, Copper—17 eV, Molybdenum—24 eV, Tungsten—33 eV, Tantalum—26 eV. These experimental results are taken from a monograph "Ion-Plasma Processing of Materials" by Ivanovsky et al., Publishing House "Radio and Communications", Moscow, 1986, p. 29. The optimum energies for maximum sputtering by ion beams are 300-500 eV and also presented in Ivanovsky's et. al. monograph. This publication is incorporated herein by reference.

Still another object of the present invention is introduction of a Hall-current ion source with specific characteristics of gas discharge utilizing high electron emissions from a cathode that are higher than a discharge current. High electron emissions maintain and enhance gas discharge at low discharge voltages. These low discharge voltages are under 50 V, which at regular electron emissions are impossible to achieve, because discharge voltages lower than 50 V are not able to maintain gas discharge in an ion source, unless there are utilized quite high pressures in vacuum chamber of about 1-2 and more Millitor. Ion beam energies under 30 eV produced by this ion source are utilized for certain technological processes such as a biased target deposition and an ion assisted deposition. Selected low magnetic field values and high electron emission currents stimulate discharge at low discharge voltages, which are equivalent of low ion beam energies that are impossible to have at magnetic fields regularly used in Hall-current ion sources and electron emission currents that are equal to discharge currents, $I_{em} \approx I_d$. High electron emissions enhance discharge and help to obtain higher ion beam currents in comparison with approximately equal emission and discharge current, $I_{em} \approx I_d$.

Another object of the invention is to present certain quantitative relationship between a Hall-current ion source discharge voltage $V_d$, a magnetic field value, $B_z$ provided by a permanent magnet or electromagnetic coil placed at a bottom of a conical anode, under a gas distributor-reflector, or in any other area of an ion source magnetic system, and a value of electron emission current applied into discharge, $I_{em}$, which is higher than discharge current value, or $I_{em} > I_d$. Such relationship can help for ion source users in selection the correct magnetic field values, $B_z$ and electron emission current values, $I_{em}$ for obtaining necessary range of discharge voltages (ion beam energies). Magnetic fields for low ion beam energies and magnetic fields for high ion beam energies can be varied by simple substitution of permanent magnets of necessary magnetic field strength, or by applying various electrical currents into an electromagnetic coil. High electron emission currents require a cathode that can provide an emission current higher than a discharge current and this cathode also provides electrons for neutralization of ions.

A further object of the present invention is introduction of a gas distributing system with placement of working gas holes with direction of these holes tangentially to a cylindrical buffer area located under anode in a way that a flow of working gas coming at pressure substantially higher (several Torr) than in a vacuum chamber ($10^{-5}$-$10^{-3}$ Torr) and at this condition providing a vortex flow that helps to eliminate discharge pinching and reduces erosion of a gas distribution system (reflector) substantially. As a part of a such gas distributing system a placement of a circular enclosure (a ring) around a reflector's central part serves a purpose to divide working gas flow into separate areas under anode lower part in order to reduce discharge pinching in a reflector's central part.

Another object of the present invention is introduction of a certain safety device that can detect an ion beam penetration through reflector. A stainless steel cup under a floating potential is placed on a top of a permanent magnet for registering a possible ion beam penetration through reflector. This cup is separated from permanent magnet by a dielectric disk. Electrical potential from a floating cup shows a moment of ion beam penetration into a permanent magnet. This simple device allows stopping an ion source operation immediately at ion beam penetration through reflector.

Another object of the present invention is introduction of working gas through holes in anode, as alternative way in a working gas application into a discharge channel, and as a method for prevention from anode oxidation when an ion source operates at a close distance to a target and in oxygen or similar environment producing dielectric depositions on anode surface.

Yet another object of the present invention is to provide an ion source with a main magnetic system that is easy to open from an ion source outside shell for a substitution of a permanent magnet of a certain magnetic field strength for a required permanent magnet for providing an ion source with specific range of discharge voltages that are necessary for various technological processes.

Another object of the present invention is to introduce a Hall-current ion source with an ion beam utilizing a permanent magnet's, or electromagnetic coil magnetic field that provides a broad beam of high current with necessary mean energies and a with a filtering schematic between a Power Supply and an ion source's anode electrical circuit that helps to suppress high amplitude discharge current and voltage oscillations at high discharge voltages over 300 V, and provide ion source operating discharge voltages over 300 V and up to about 1000 V. Ion beams of high energies of such an ion source can be utilized for etching and sputtering in optimum range of bombarding ion energies of 300-500 eV.

BRIEF DESCRIPTION OF THE DRAWINGS

Features of the present invention, which believed to be patentable are set forth with particularity in the appended claims. The organization and operation manner of the invention, together with further objectives and advantages thereof, may be understood by reference to the following descriptions of specific embodiments taken in connection with accompanying drawings, in the several figures of which like reference numerals identify similar elements in which:

DESCRIPTION OF THE PREFERRED EMBODIMENTS

Figure 1:
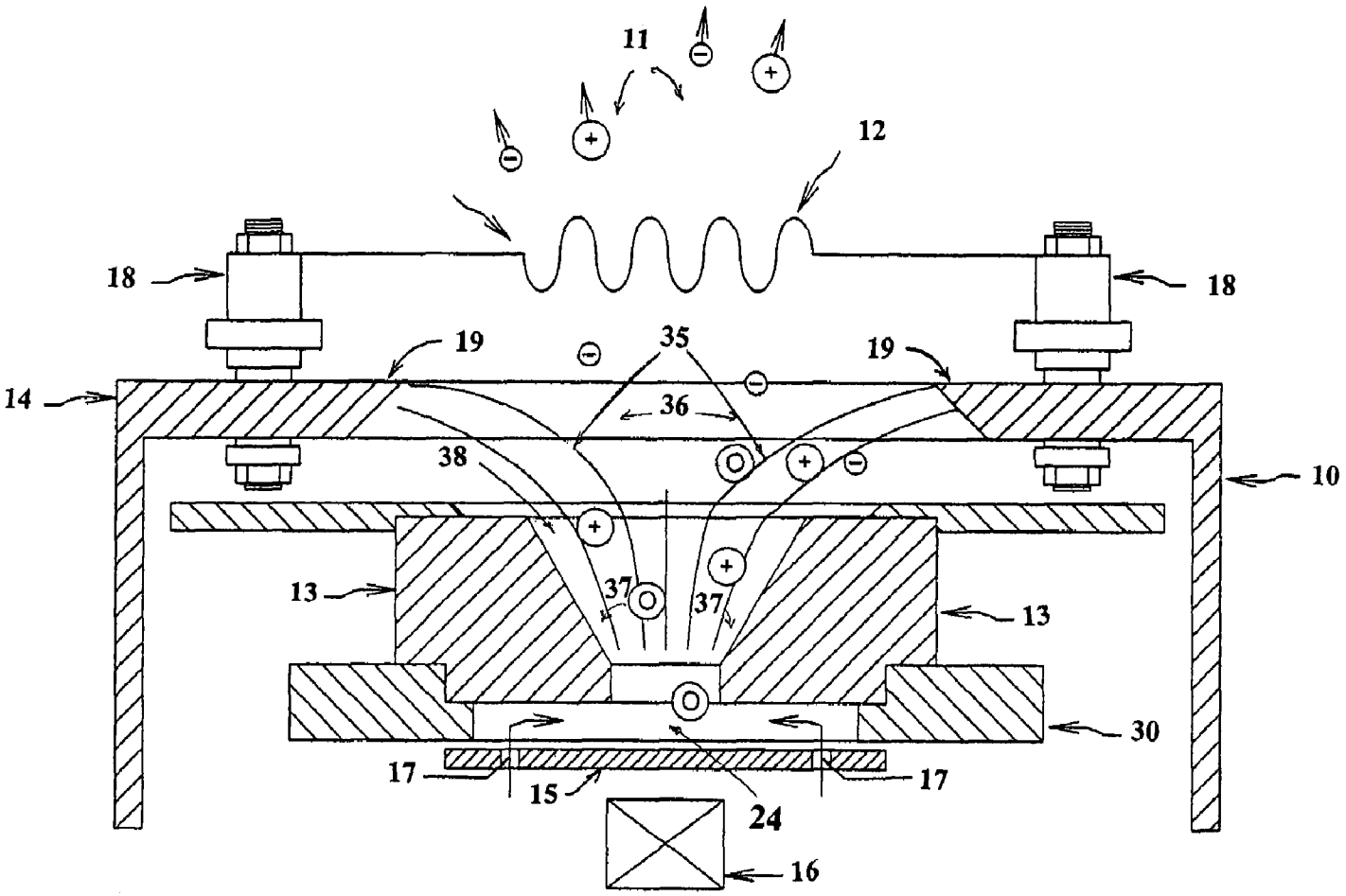
Fig. 1 (PRIOR ART)
FIG. 1 is a schematic drawing of a prior art apparatus of a Hall-current ion source called an end-Hall ion source that is described by Kaufman, et al. in U.S. Pat. No. 4,862,032.
Figure 2:
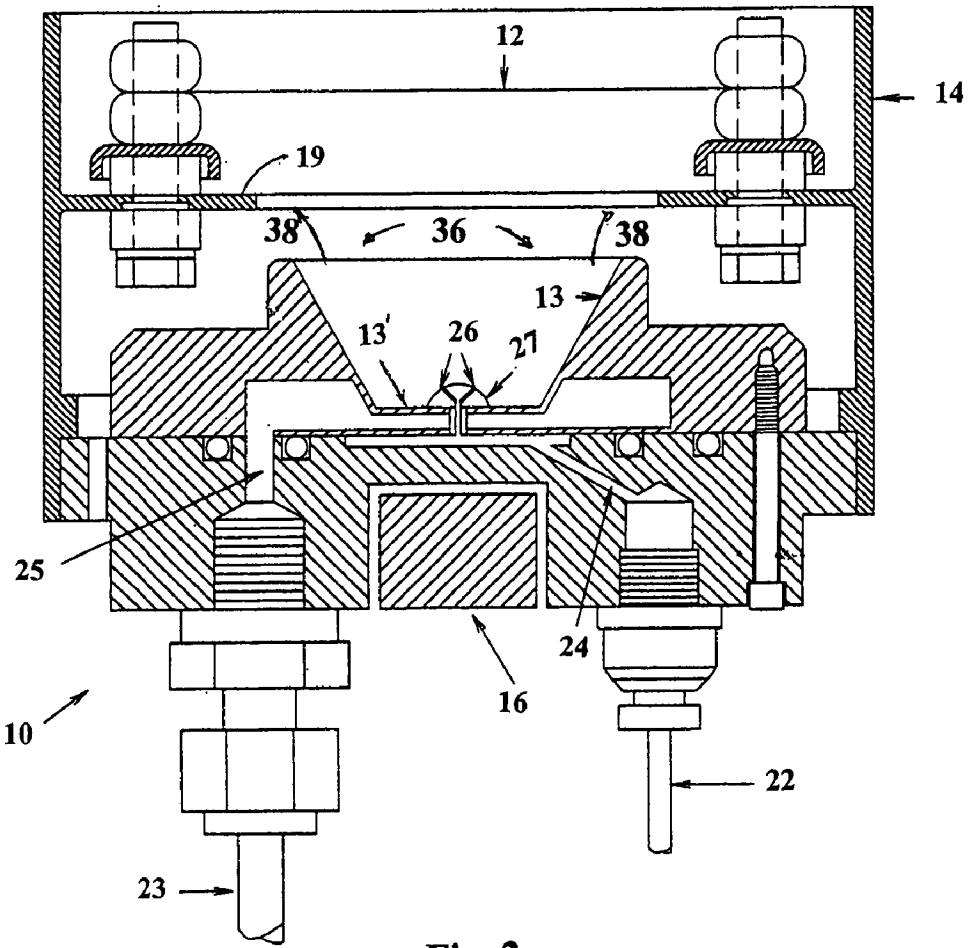
Fig. 2 (PRIOR ART)
FIG. 2 is a schematic drawing of a prior art apparatus of end-Hall ion source described by Sainty in U.S. Pat. No. 6,645,301 B2.

FIGS. 1 and 2 present schematic drawings of end-Hall ion sources described in U.S. Pat. No. 4,862,032 by Kaufman et al., and in U.S. Pat. No. 6,645,301 B2 by Sainty. Both figures show typical Hall-current ion source apparatus 10 surrounded by a vacuum enclosure (not shown), with vacuum chamber that is maintained at low pressure by a preliminary pumping at about $10^{-7}$ torr to $10^{-4}$ Torr (typical vacuum conditions of most users of ion sources in thin film technology). End-Hall type ion sources have magnetic field lines 35 that are mostly axial in area of a gas distributing system 24 and radial magnetic field lines in area of an ion source exit 38. An ion source has a magnetic system (shown only an upper part for simplicity) consisting of several parts such as: a magnet 16 representing an internal pole, magnetically permeable shell 14 with an external magnetic pole 19. An ion source 10 produces a plasma flow consisting of ions (on FIG. 1, plussign) accompanied by electrons (on FIG. 1, minussign). Neutralized plasma 11 exits from an ion source's discharge channel 36.

End-Hall ion sources presented in FIGS. 1 and 2 have conical anodes, 13 and cathodes in a form of Hot Filament, 12. Alternative cathodes such as Hollow Cathode electron source, or a Plasma Bridge are used with such ion sources. Both ion sources regularly use permanent magnet at a bottom part under anode (though it is possible to use electromagnets, and magnets can be placed in various parts of a magnetic system) and separated by a gas distributing system 24. The difference between these two ion sources is that in the Kaufman's ion source (FIG. 1) gas distributor-reflector 15 is under a floating potential and in the Sainty's ion source (FIG. 2) reflector 13' is under anode potential.

Both ion sources utilize massive hollow conical anodes 13. Gas distributing system 24 plays very important role in a supply of a working gas into a discharge channel. How well working gas is applied into a discharge channel, how uniformly it is distributed, influences on stability and range of operation conditions. For example, in the Kaufman's ion source (FIG. 1) working gas is applied into a gas distributing area through multiple holes 17 placed under an anode. In the Sainty's ion source (FIG. 2) working gas is applied into a discharge channel using a "head shower" 27 through holes 26.

Figure 3:
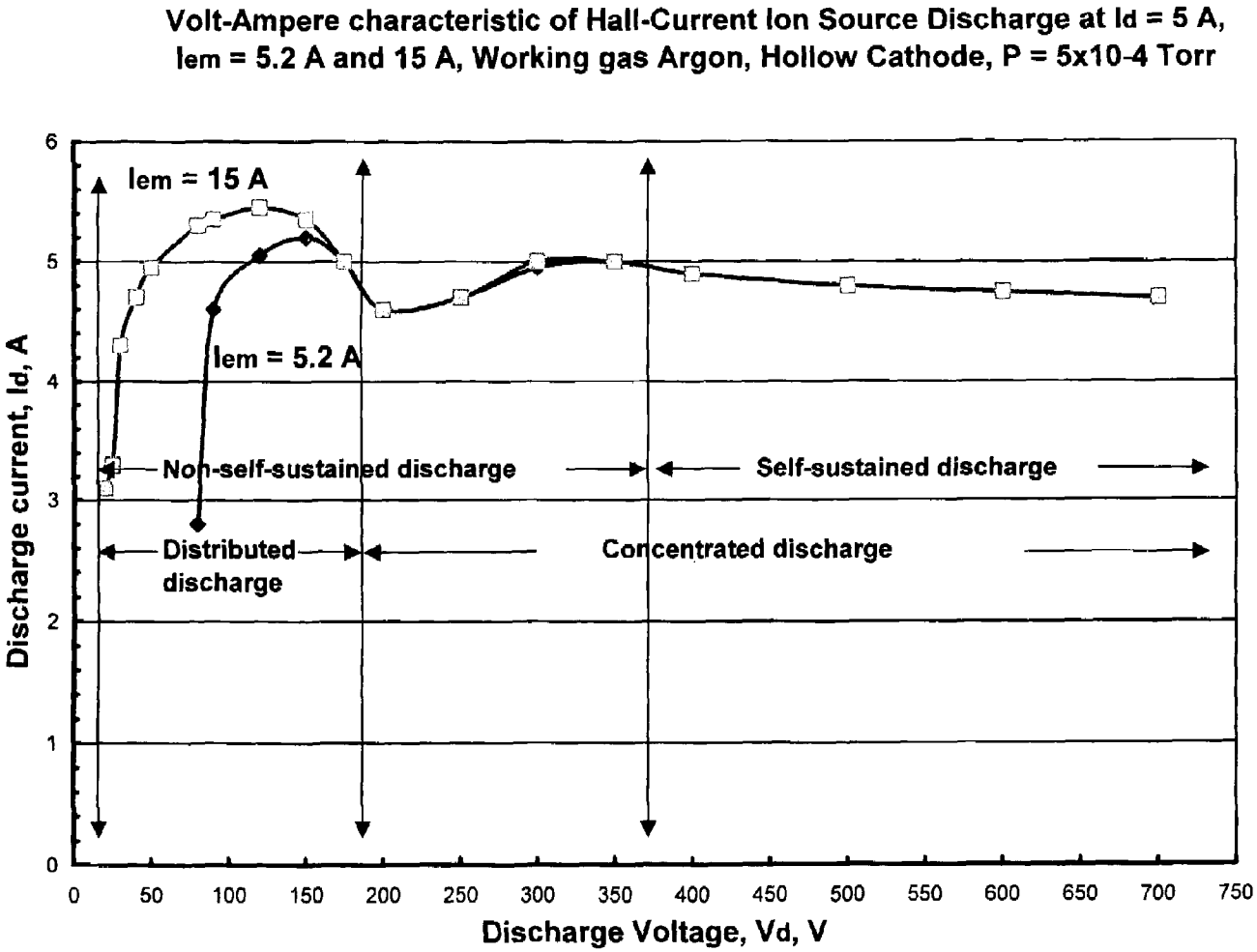
FIG. 3 is a graphical representation depicting Volt-Ampere Characteristics of high current intense discharge in a Hall-current type ion source. These Volt-Ampere characteristics show various areas of a gas discharge behavior and, especially, in a low-voltage area at regular and high electron emissions for the invented Hall-current ion source. The operation conditions in this case are as follows: working gas Argon, discharge current, $I_d$=5 A, two different electron emission currents, $I_{em}$=5.2 A and $I_{em}$=15 A, an electron source is a Hollow Cathode, pressure in vacuum chamber, $P_{ch}=5\times10^{-4}$ Torr.

Before discussion of the invented Hall-current ion source with expanded discharge voltage parameters into low energy and into a high energy sides of discharge voltages it is necessary to present fundamental features and behavior of electrical discharge in regions close to discharge extinction. In FIG. 3 there are shown typical Volt-Ampere (V-A) characteristics of a Hall-current ion source discharge, for discharge current, $I_d$ as function of discharge voltage $V_d$. Working gas is Argon, pressure in vacuum chamber is between $5\times10^{-5}$ and $(1\text{-}2)\times10^{-3}$ Torr. For these conditions, magnetic field value of a permanent magnet, or electromagnet is between 400 and 1500 G. As one can see, a low-voltage part of V-A characteristics consists of two branches: a left curve is for a high emission current, $I_{em}$=15 A, or $I_{em}>I_d$, and a right curve corresponds to discharge current, $I_d \approx I_{em}$, dependence of discharge voltage, $V_d$ that corresponds to typical operating conditions, when discharge current and emission current are approximately equal to each other. These two curves of V-A characteristics show importance of a high emission current for maintaining gas discharge at low discharge voltages. At discharge voltages over about 200 V discharge current practically does not depend on discharge voltage, because at $V_d \geqq 200$ V neutral atoms are practically all completely ionized and discharge current value becomes saturated. Volt-Ampere characteristics for other gases such as Xe, or $O_2$ and $N_2$ are similar. Heavy working gas Xe with its low first ionization potential ($E_{ion}$=12.13 eV) has discharge voltages in lower area than Argon ($E_{ion}$=15.76 eV), down to about 15-20 V, but $O_2$ and $N_2$ start discharge at voltages about 70-80 V and up. Argon is in between these gases.

In article by Liapin et. al., "*Modern State of investigations of Accelerators with Anode layer*" in "*Ion Injectors and Plasma Accelerators*" edited by Morozov et. al., Moscow, Publishing House "Energoatomizdat", 1990, pp 20-33, there are presented similar V-A characteristics for a Hall-current closed drift thruster/ion source with description of various areas of gas discharge behavior at a regular condition with $I_{em} \approx I_d$, working gas is Argon. This publication is incorporated herein by reference.

As one can see in FIG. 3, electrical discharge at the discharge voltage between $V_d \approx 80$ V (for the condition that $I_{em} \approx I_d$), or between $V_d \approx 25$ V (for the condition that $I_{em}>I_d$) and $V_d \approx 370$-380 V, presents itself a so-called non-self-sustained discharge. It means that in order to initiate and maintain discharge and ionize neutral atoms, it is necessary to provide ionizing electrons from cathode into a discharge channel. These electrons ionize neutral atoms and neutralize ions generated during electron-atom collisions in a discharge channel, and outside of a discharge channel electrons serve for neutralization of an ion beam. FIG. 3 also shows that a role of high electron emission is important in a region from about 20 V to about 175 V; then, after $V_d \approx 175$ V, both curves for $I_{em} \approx I_d$ and $I_{em}>I_d$ coincide with each other.

It is necessary to note that in order to have conditions of a low voltage discharge, in practice, it is advisable to start discharge at higher discharge voltage, like $V_d$=100 V with $I_{em} \approx I_d$, or at $V_d \approx 60$-70 V with $I_{em}>I_d$, and then gradually decrease discharge voltage value by a Power Supply to a required lower value. A "nice" first ionization potential gas Xenon "allows" is starting with voltages of 50 V and lower with $I_{em} \approx I_d$, and at about 30 V at $I_{em}>I_d$.

Discharge behavior with a discharge voltage over $V_d \approx 370$-380 V presents itself a self-sustained discharge when it is not necessary to supply electrons from a cathode-neutralizer for neutralization of ions. After discharge is initiated, a high voltage discharge produces sparks creating electrons in discharge channel and outside of an ion source, in vacuum chamber walls. Also, discharge at low discharge voltage and up to about $V_d$=180 V presents itself a distributed discharge over a discharge channel. A discharge at higher discharge voltage over 180 V presents itself another modification called a concentrated discharge. These modifications received such names because they are observed from outside of a vacuum chamber as distributed and concentrated forms of discharge.

Most Hall-current ion sources that are on a market for thin film technology have cathodes-neutralizers. The invented Hall-current ion source in area with a non-self-sustained discharge was studied with a cathode-neutralizer (both, Hot Filament and Hollow Cathode) that is placed at the exit of an ion source discharge chamber. Electrical discharge in an ion source discharge channel can be characterized by the following operating parameters: discharge current, $I_d$, emission current, $I_{em}$ provided by a cathode-neutralizer, discharge voltage, $V_d$, working gas (any gas that can be ionized, noble or reactive) mass flow supplied into anode area, $\dot{m}_a$, magnetic field in a discharge channel, axial component, $B_z$ and radial component, $B_r$. If a cathode-neutralizer is a Hollow Cathode, or a Plasma Bridge, or similar device, a cathode mass flow value, $\dot{m}_{HC}$ should be also taken into account for a total mass flow applied into a vacuum chamber. In general, an anode mass flow is significantly higher than a Hollow Cathode mass flow, or $\dot{m}_a >> \dot{m}_{HC}$. Usually, in conditions of a non-self-sustained discharge, both discharge and emission currents are utilized approximately equal to each other, or $I_{em} \approx I_d$. It is assumed that emission current provides a number of electrons per unit time and area that is equal to a number of ions per unit time and area. There are no works in scientific literature justifying the right value of the emission current for the non-self-sustained discharge, especially for the low voltage discharge area. In practice, Hall-current ion sources operate with an emission current that is slightly higher than a discharge current by about 5%.

An approximate equality of discharge and emission currents works satisfactory (meaning that there are no observed electric sparks, or arcing in a vacuum chamber) at discharge voltages $V_d \geqq 100$ V. Though, the right ratio of emission current to a discharge current should be determined by measuring a charging potential of target placed at working distance from an ion source in a specific technological process. Target placed at certain distance from an ion source exit should not be charged neither positively (insufficient neutralization caused by insufficient supply of emission of electrons, called sometime as under-neutralization), nor negatively (over-neutralization, overflow of electrons). Experiments with ion sources and targets show that for a target with a zero potential it is usually necessary to apply emission current higher than discharge current, and, in many cases, substantially more than 10% over a discharge current.

With low discharge voltages, less than 100 V, the situation is quite different. As one can see in FIG. 3, at a right branch of a V-A characteristics, at $V_d \approx 50$-60 V discharge begins to extinguish. It happens always with approximately equal discharge and emission currents, $I_{em} \approx I_d$. However, the application of an emission current higher than a discharge current by a factor 2-3 helps to ionize neutral particles and maintain discharge at substantially lower voltages. Role of magnetic field in low voltage branch of volt-ampere characteristics is also clear. Lower magnetic field values do not produce much of obstacle for motion from cathode to anode area; higher magnetic fields make electrons propagation more difficult (however, at zero magnetic field in ion source discharge channel regular discharge can be transformed into uncontrollable arc form). FIG. 3 shows that a left curve of V-A characteristics corresponds to $I_{em}>I_d$ and discharge voltages are in a low-voltage region.

Since the introduction of a Hall-current ion source in 1989 by Kaufman et al. in U.S. Pat. No. 4,862,032 and later in patents by Kaufman and Sainty, there was no data presented in literature about a value of magnetic field that should be utilized in discharge channel of such ion sources. For larger ion sources, like Mark-2, EH-1000 and ST3000, as was discussed above, magnetic field at the side of a North pole magnet is about 1300-1500 G. In general, permanent magnets with high magnetic field and high Curie (about 500 C.) temperature are utilized. The higher is Curie temperature, the higher electrical power can be applied into a discharge channel. One of the main factors limiting utilization of high discharge currents and voltages, and correspondingly high powers, is possible overheating of a permanent magnet that can lose its magnetic strength being overheated.

Closed drift ion sources and thrusters utilize significantly lower magnetic fields in discharge channel than in end-Hall ion sources. Such data are presented in PA US 2005/0237000 by Zhurin and in article by Zhurin, et al., "Physics of Closed Drift Thrusters" in *Plasma Science & Technology*, Vol. 8 (1999), beginning on page R1. Experiments confirm that a kind of a working gas, its mass and "ionizing ability" (a first ionization potential value) influence on magnetic field that is applied into a discharge channel to provide conduction of electrons in anode area in a way that electrons would not go straight from cathode to anode area but with extended passage (closed loops) so it will be enough time for electrons to collide with neutrals providing theirs ionization. It was found that for Hall-current ion sources, at each value of a discharge voltage, $V_d$ and working gas mass flow through anode, $\dot{m}_a$ there is an optimum value of magnetic field, $B_{opt}$, at which ratio of an ion beam current to a discharge current, $I_i/I_d$ reaches its maximum value, $I_{i,max}$. The optimum value of magnetic field in closed drift ion sources and thrusters increases with the increase of a discharge voltage, $V_d$ and a working gas mass flow, $m_a$. For closed drift thrusters/ion sources a following empirical dependence was obtained, $H_{opt}\sim V_d^{1/4}\dot{m}_a^{1/2}$. This relationship is given in a monograph "Stationary Plasma Thrusters" by Belan et al., published by Kharkov Aviation Institute, 1989, p 187. This publication is incorporated herein for reference. The dependence for $B_{opt}$ is also influenced by specific working gas properties such as atomic mass and its first ionization potential. For working gases with high atomic mass $B_{opt}$, like Xenon an optimum magnetic field value for $V_d$=300 V is equal to about 600 G, and for Argon, at $V_d$=300 V an optimum magnetic field value is only 150-200 G. It is necessary to note that magnetic field values given for a closed drift ion thrusters-sources are at maximum at a discharge channel exit, because closed drift thrusters-sources as a rule use a positive gradient of magnetic field in a discharge channel and in an anode area magnetic field usually is about zero. In the case of Hall-current ion sources, such as end-Hall-type ion sources with a negative gradient, magnetic field decreases from a reflector, which is placed under an anode, from about 1000 G at reflector, and it becomes equal to about 50-70 G at a discharge channel exit.

Figure 4:
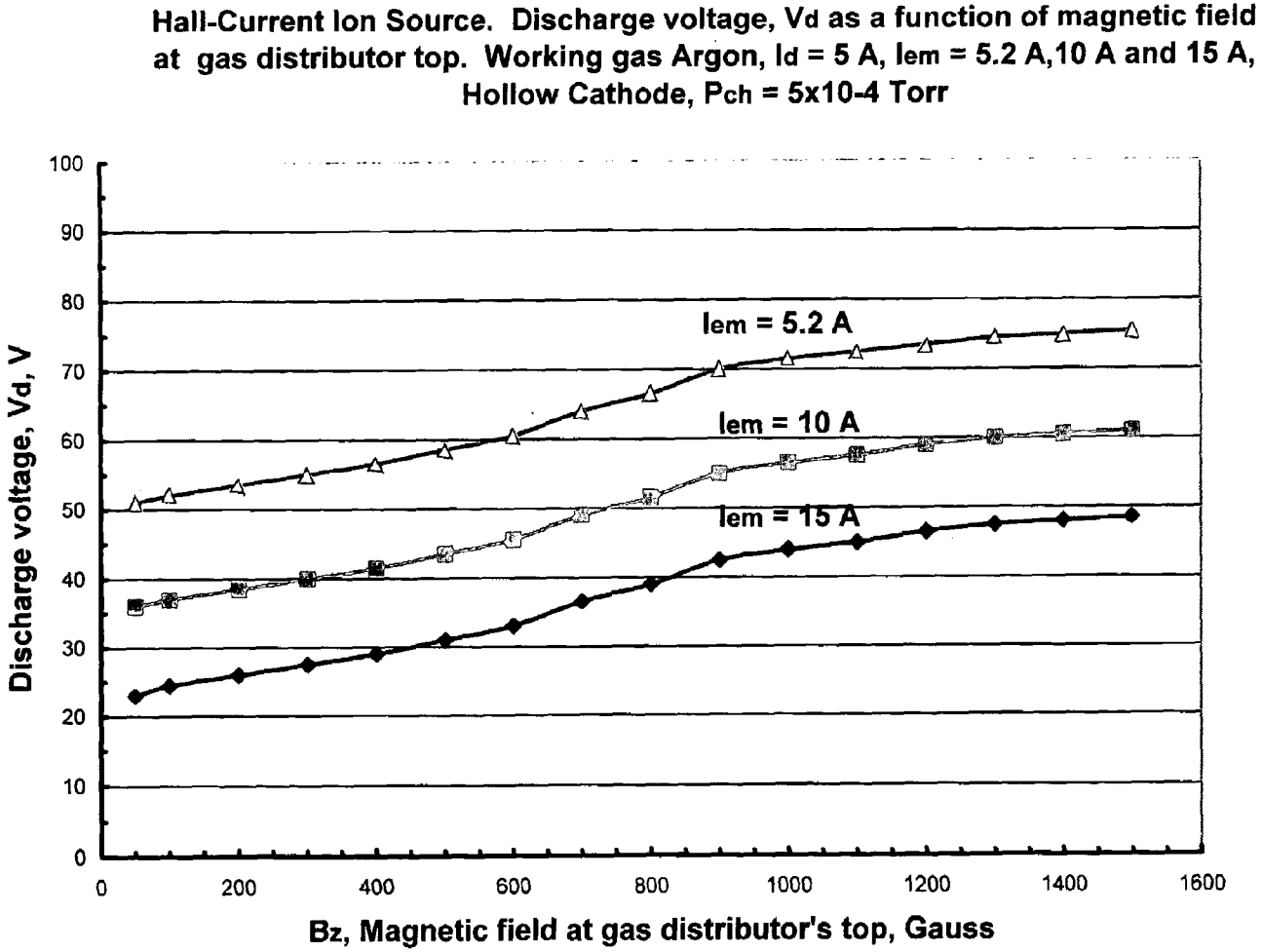
FIG. 4 is a graphical representation of the invented Hall-current ion source of discharge voltage, $V_d$ dependence as a function of magnetic field value, $B_z$ (Gauss) at the top of a gas distributing system (reflector) for typical discharge parameters such as: working gas Argon, discharge current, $I_d$=5 A and various emission currents, $I_{em}$=5.2 A, 10 A and 15 A, pressure in vacuum chamber, $P_{ch}=5\times10^{-4}$ Torr, gas flow through ion source, $\dot{m}_a$=100 sccm.

FIG. 4 presents another study with the invented Hall-current ion source where for various emission currents, $I_{em}$=5.2, 10 and 15 A there is shown the discharge voltage, $V_d$ as function of a Hall-current ion source magnetic field value, $B_z$ at a gas distributor top at constant discharge current, $I_d$=5 A (as an example) with Argon as working gas. As one can see, magnetic field value plays very important role in providing low discharge voltages at lower magnetic fields. With low magnetic fields of about 100-200 G and with high emission current of $I_{em}$=15 A it is possible to have discharge voltages of about 22-25 V, which correspond to $E_i\approx$13-15 eV of ion energy. Such energies are lower than the sputtering threshold energies of most used materials in vacuum chambers. Further study of low magnetic field values for Hall-current ion sources shows that utilization of low magnetic fields of $B_r\approx$200-300 G leads to a maximum range of discharge voltages of about 200-250 V. Increase of discharge voltages at such low magnetic fields in Hall-current ion source leads to development of strong discharge oscillations such as contour and ionization oscillations. For higher discharge voltages it is necessary to increase magnetic field of permanent magnet, or electromagnet in a range of magnetic fields of 1000-1500 G. Zhurin et al. describe various types of oscillations that exist in Hall type ion sources in the above mentioned article "*Physics of Closed Drift Thrusters*" in *Plasma Sources Science & Technology,* Vol. 8 (1999), beginning on page R1.

From FIG. 4 one can see that in case of Argon as working gas the discharge voltage value, $V_d$ can be approximated by a linear function of magnetic field, $B_z$ on a reflector's top. Higher electron emission currents shift discharge voltage to lower values for each extra 1 A of emission current by about 2 V of discharge voltage. Every extra 1 Gauss of magnetic field increases discharge voltage by about 0.02 V. Empirical formula for Hall-current ion sources for discharge voltage, $V_d$ as a function of magnetic field, $H_z$, anode mass flow, $\dot{m}_a$ and extra emission current, $I_{em}\geqq I_d$, can be presented in the following form: $V_d\sim[k_1B_z-k_2(I_{em}-I_d)]\dot{m}_a^{-1/2}$, where coefficients $k_1$ and $k_2$ depend on working gas properties such as first ionization potential and molecular mass. This formula provides optimum values of magnetic field, $B_z$ and electron emission current, $I_{em}$, which should be utilized for necessary low energy operation of a Hall-current ion source.

From FIGS. 3 and 4 one can make a conclusion that high electron emission and low magnetic field can significantly reduce operating discharge voltages at constant discharge current. There is another interesting feature that justifies utilization of high emission current that higher than discharge current in Hall-current ion sources. In the above mentioned publication "Low-Energy End-Hall Ion Source Characterization at Millitorr Pressures" by Kahn et al., SVC 48$^{th}$ Annual Technical Conference Proceedings, p 445, 2005, high working gas pressures in vacuum chamber of about 1-2 mTorr with Argon as working gas were used for obtaining lower discharge voltages of about 42 V ($E_i\sim$25.2 eV). Our studies show that high electron emission current, $I_{em}>I_d$, in comparison with the electron emission that equals to a discharge current, $I_{em}\approx I_d$, with the same discharge voltage, $V_d$ significantly decreases working gas mass flow, $\dot{m}_a$ by 1.2-1.5 times. This feature is important to help in certain cases to keep working gas mass, $m_a$ flow lower with $I_{em}>I_d$, than at $I_{em}\approx I_d$ and correspondingly helps to have lower pressure in vacuum chamber. Thus, for obtaining low ion beam energies with a Hall-current ion source, instead of high pressure in vacuum chamber and in ion source it is expedient with a low range of discharge voltages, $V_d\leqq$125 V to use the optimum magnetic field, $B_{z,opt}$ and the optimum high electron emission, $I_{em,opt}$, than to use high mass flows of working gas. As it was discussed above, at high gas pressures in vacuum chamber of about 1-2 mTorr a charge-exchange process influences significantly on ion beam propagation before reaching a target.

Figure 5:
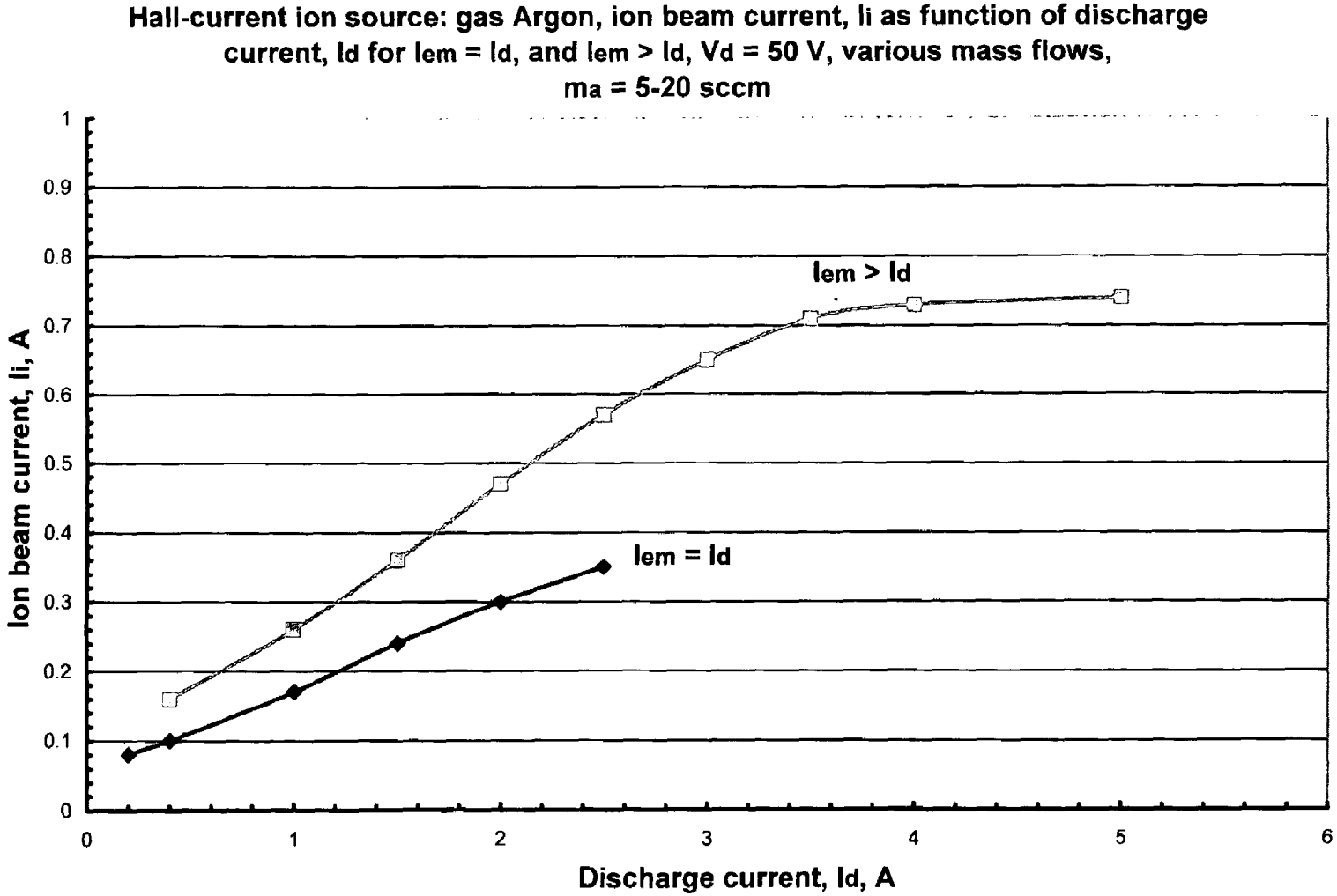
FIG. 5 is a graphical representation of the invented Hall-current ion source of an ion beam current, $I_i$ dependence as a function of discharge current, $I_d$ for various emission currents for $I_{em}\approx I_d$ and $I_{em}>I_d$ at discharge voltage, $V_d$=50 V, working gas Argon, various mass flows through ion source, $\dot{m}_a$=5-20 sccm, magnetic field at reflectors top, $B_z$=700 G.

FIG. 5 presents experimental dependence for the invented Hall-current ion source ion beam current, $I_i$ as a function of discharge current, $I_d$ at different emission currents, with $I_{em}=I_d$ and $I_{em}>I_d$ at constant discharge voltage, $V_d$=50 V. FIG. 5 shows that high emission currents higher than discharge current, $I_{em}>I_d$ provide higher ion beam currents by a factor $q=I_{i,Iem>Id}/I_{i,Iem\sim Id}$=1.5-1.6 in comparison the case when discharge current and emission current are approximately equal to each other, $I_{em}\approx I_d$. As one can see from FIG. 5, a range of discharge currents with higher emission, $I_{em}>I_d$ is up to 5 A for given mass flow range of 5-20 sccm, Argon (higher discharge currents need higher mass flows of working gas).

Figure 6:
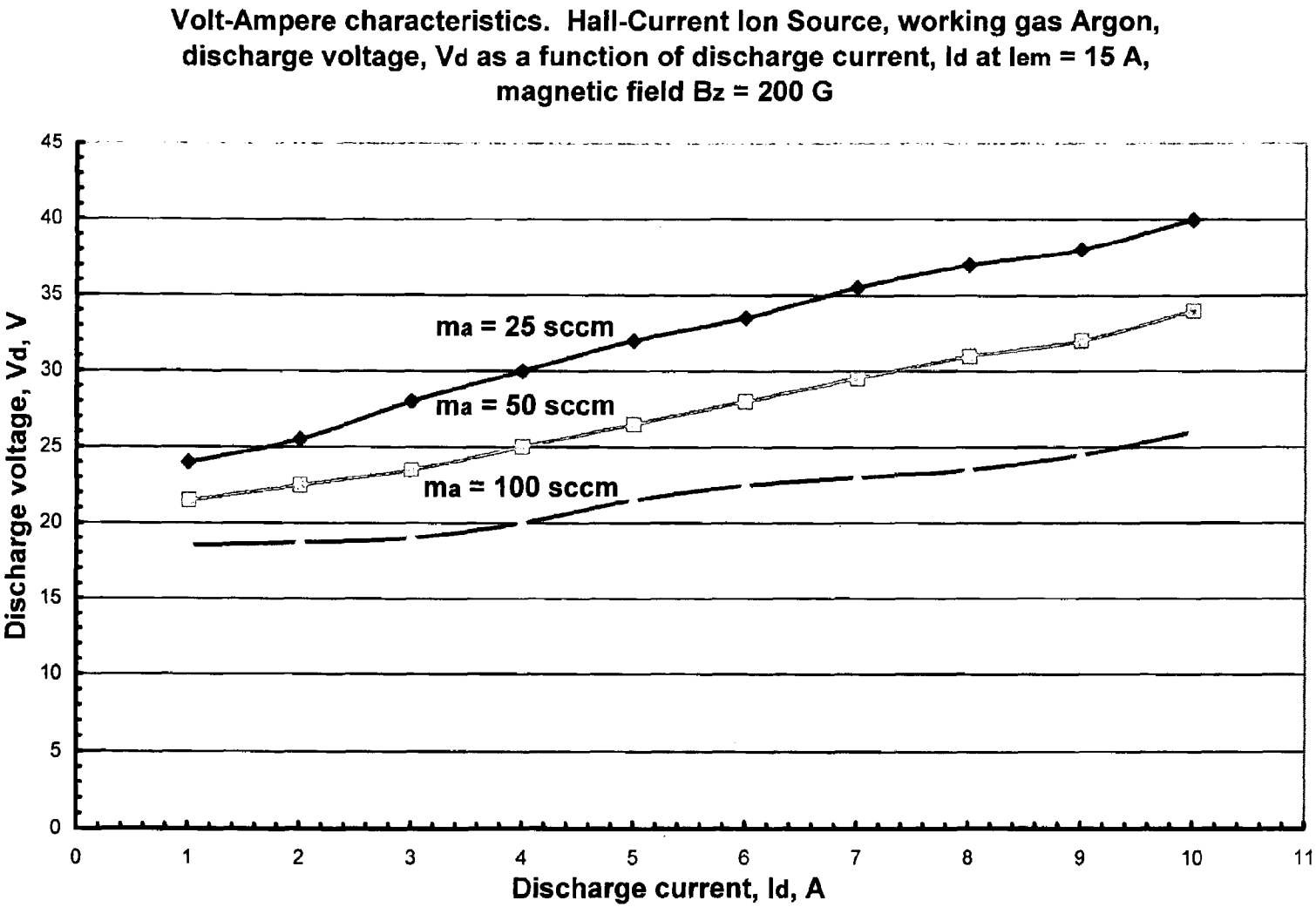
FIG. 6 is a graphical representation of the invented Hall-current ion source of a discharge voltage, $V_d$ dependence as a function of a discharge current, $I_d$ with a high emission current, $I_{em}$=15 A and a comparatively low value of magnetic field at a top of a gas distributing system, $B_z$=200 G.

FIG. 6 presents Volt-Ampere characteristics of the invented Hall-current ion source with low magnetic field of 200 G at the top of a gas distributing system-reflector. In this case, working gas is Argon, and various gas mass flows are applied through a gas distributing system, $\dot{m}_a$=25 sccm, 50 sccm and 100 sccm. Discharge currents are varied from 1 A to 10 A, and discharge voltages are varied from 18 V to 40 V. Also a high electron emission current, $I_{em}$=15 A is provided by a Hollow Cathode. Pressures in vacuum chamber are from $2.5\times10^{-4}$ Torr, $3.4\times10^{-4}$ Torr and $6.8\times10^{-4}$ Torr, correspondingly. At this selected low magnetic field on a reflector's top of 200 G, for the high discharge currents of 10 A and for all above presented mass flows (25-100 sccm) through anode area the discharge voltages are under $V_d$=40 V, which is equivalent of a mean ion energy of about 24 eV. The lowest discharge voltage of 18 V gives an ion beam mean energy of about 11 eV.

As one can see from FIG. 1 (prior art, Kaufman et al. ion source) and FIG. 2 (prior art, Sainty's ion source) a gas distributing system 24 in end-Hall ion source occupies a comparatively small area in a discharge channel of an ion source. In such a small area, there is no sufficient place for good gas mixture of applied working gas into the area under anode in Kaufman's et al ion source, and in a Sainty's ion source working gas is applied directly into anode area without any mixing. Gas pressure in a vacuum chamber with operating Hall-current ion source is usually $10^{-5}$-$10^{-4}$ Torr, but pressure in a discharge channel in area where working gas is applied is substantially higher, depending on a working gas mass flow. This mass flow should be distributed uniformly in an anode area, so discharge will be developed over most of anode surface. Also, it is necessary to note that at low pressures of $10^{-5}$-$10^{-4}$ Torr gas molecules propagate from a gas distributing system in straight lines, so in Sainty's ion source (FIG. 2) a certain part of applied mass flow through so-called "shower" holes 26 can be lost (not participating in ionization and acceleration process in discharge) through discharge channel 36.

Figure 7:
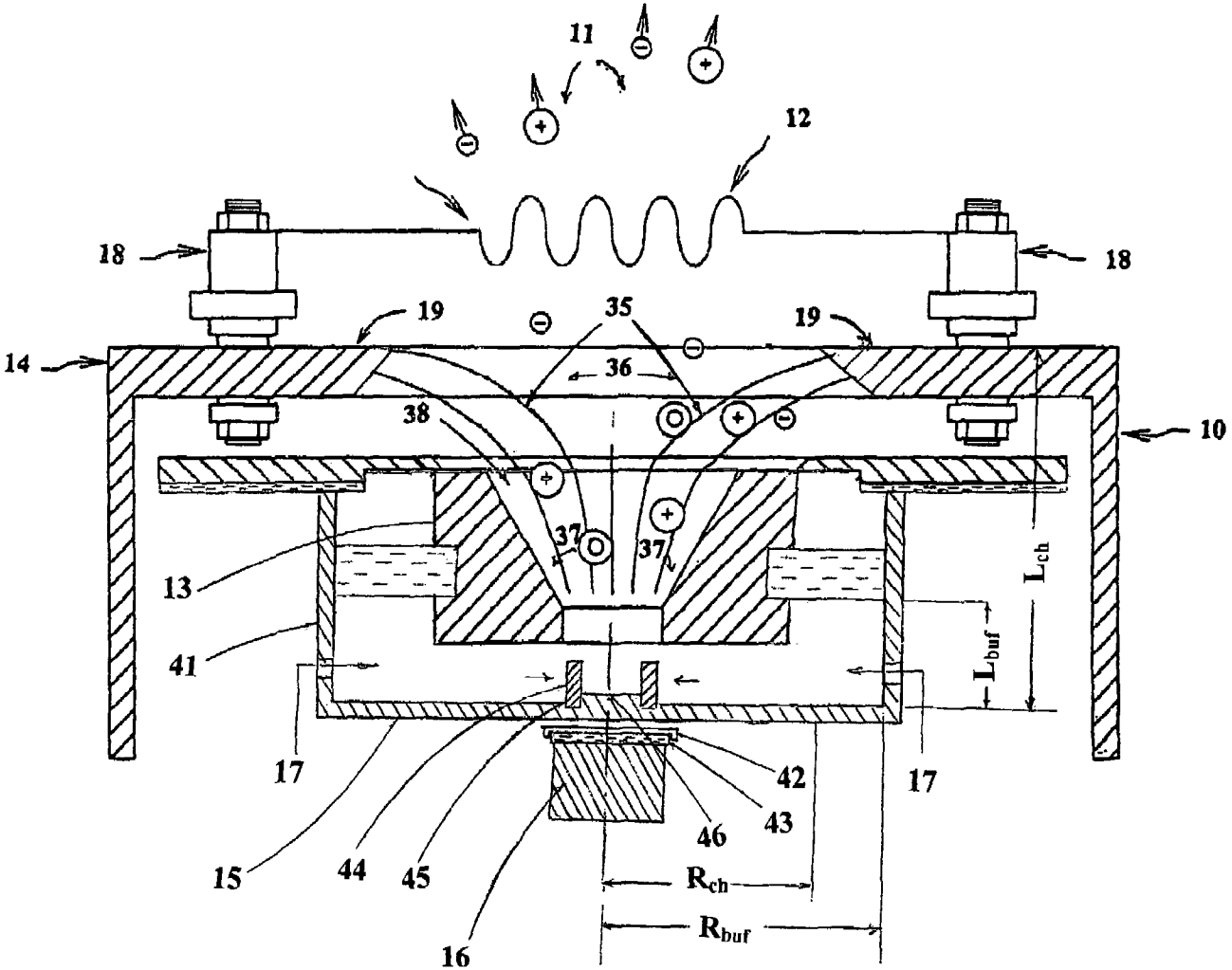
FIG. 7 presents a schematic drawing of the invented Hall-current ion source with modification for a gas distributing system having a buffer chamber under an anode area. This gas distributing system provides more uniform supply of a working gas into an anode discharge area. Such configuration of gas passage through a gas distributing system with direction of applied gas at a sharp angle of gas holes tangentially to a gas distribution chamber wall for application of working gas into a buffer chamber with arrangement of a vortex flow. Protecting hollow ring of about 10-15 mm in diameter, about 5-7 mm in height and about 1 mm in thickness is installed into a reflector's central part for decreasing gas flow in a reflector's central area. Reflector's central part in a protective hollow ring is slightly thicker than regular reflector's thickness by 3-5 mm. Stainless steel protective cup is placed on a top of a permanent magnet with a dielectric disk in between providing electrical separation of a stainless steel cup from magnet having a ground potential. This protective cup is connected through a resistor to voltmeter, or Power Supply for registering potential induced by an ion beam penetration through reflector.

FIG. 7 presents schematic drawing of the invented Hall-current ion source with features that make this ion source more efficient and with broader range of discharge voltages and, correspondingly, energies. An ion source 10 with a magnetic system 14, 19 and a permanent magnet 16 (for simplicity, the rest of magnetic system that is under a magnet is not shown), with a discharge channel 37 has anode 13 and a Hot Filament cathode 12 utilized for generation of electrons that ionize neutral particles and for neutralization of ions in and outside of ion source. Among new features one can see a gas distributing system with a buffer chamber 41. A circular gas distributing system is placed in a buffer chamber where working gas is applied through holes 17. These holes 17 have a diameter from about 0.4-0.5 mm to about 1 mm, and they supply working gas into a buffer chamber 41 tangentially to a radial direction. A number of holes that was found optimal are from 36 to 48.

A buffer chamber 41 plays important role in a Hall-current ion source operation. First of all, it helps to develop an optimum uniform gas distribution for ionization and acceleration, and, second, it gives a possibility, when necessary, for a preliminary ionization of applied working substances that in general are poorly ionized. For obtaining high ion beam currents a preliminary ionization helps increasing efficiency of utilization of a working material and provides regulation of an ion source in a broad range of major parameters such as discharge voltage and current, working gas flow.

For best performance with the invented Hall-current ion source, the buffer chamber dimensions are selected from the following relationships: $R_{buf}/R_{ch}$=1.3-1.5 and $L_{buf}/R_{ch}$=0.3-0.5, where $R_{buf}$ is an external radius of a buffer chamber, $R_{ch}$ is an external diameter of an ion source discharge channel in 19 (end of external magnetic pole), $L_{buf}$ is a buffer chamber length, $L_{ch}$ is a discharge channel length. These dimensions are shown in FIG. 7.

In the invented design a stainless steel cup 42 is placed on a permanent magnet top 16 under a floating potential. FIG. 7 shows schematic drawing with a permanent magnet 16 and a stainless steel cup 42, which are separated by insulator, such as alumna 43 that is placed between a permanent magnet 16 and a cup 42. A cup 42 is connected through a wire (not shown) to a resistor and to a voltmeter, or a Power Supply (both not shown). In case of complete ion beam penetration through reflector's 15 top 46, an ion beam becomes connected with a stainless steel cup 42, and plasma electrical potential applied to a stainless steel cup 42 is easy registered by a voltmeter, or a Power Supply.

In regular end-Hall ion sources a part of magnetic system 14 is made in a form of magnetically permeable material. It usually made of one piece as a hollow thin cylinder of about 1-1.2 mm thick and about 10-15 cm long. Since the invented ion source assumes utilization of various magnetic fields produced by permanent magnet 16, an external shell 14 of magnetically permeable material of FIG. 7 is made of two halves for easy opening the external shell and easy substitution of permanent magnet 16.

In a patent U.S. Pat. No. 6,750,600 B2 "Hall-Current Ion Source" by Kaufman et al. there is shown a modified end-Hall ion source that was described in a patent U.S. Pat. No. 4,862,032 "End-Hall Ion Source" by Kaufman et al. In its latest version of U.S. Pat. No. 6,750,600 there is presented a hollow anode of a grooved shape for operation with reactive gases such as Oxygen, Nitrogen and others and with a possibility to reduce influence of anode oxidation (or other dielectric depositions) on ion source performance. During operation with reactive gases anode becomes covered with, for example, oxide film, which deposition makes electron current difficult to penetrate into anode surface through a non-conducting film. In result, discharge voltage begins to rise continuously, which is difficult to control, leading to discharge extinguishing (with a Power Supply working in a constant current mode), or discharge current begins to decrease continuously (with a Power Supply working in a constant voltage mode) and discharge becomes extinguished after certain time. A grooved form of anode makes some parts of anode "invisible" for oxide particles (they travel at low pressures by straight lines) and helps to reduce influence of oxide film on ion source discharge parameters.

As it was above mentioned, in Hall-current, or end-Hall ion source a gas distributor called reflector 15, usually made of a stainless steel (in some cases, it made of Tantalum, Titanium, etc) for operation with reactive gases, or a graphite (for noble gases, such as Argon, Xenon, etc), which placed under a conical anode 13, suffers from damage produced by ion beam that takes place during regular ion source operation. An end-Hall ion source utilizesa magnetic field configuration with a substantial part of magnetic field having an axial direction instead of a radial direction that takes place in thrusters-ion sources with closed electron drift. A detailed investigation of differences between end-Hall type and closed drift type was presented in a U.S. Pat. No. 7,116,054 "High-Efficient Ion Source with Improved Magnetic Field" by Zhurin.

This reference was presented above. In end-Hall type ion sources, because of existence of a predominant axial magnetic field component, an ion beam is directed not only to exit from a discharge channel but also partially to opposite direction to a reflector's center part. In result, reflector becomes damaged and, in certain cases with utilized high discharge currents and voltages, it becomes completely eroded by an ion beam. Reflector 15, in such a case, gets a large hole of up to 5 mm in diameter. The damage is quite substantial because not only reflector is necessary to substitute, but permanent magnet 16 can be also damaged. In some cases, depending on an end-Hall ion source model, a small stainless steel cup 42 is placed on a top of permanent magnet, or, in order to prevent permanent magnet 16 damage the whole stainless steel plate containing an upper part of an ion source assembly is placed over a permanent magnet. The damage from a beam penetration through reflector can be very significant and plate placed over magnet and magnet must be replaced.

In FIG. 7 there is presented an alternative design of the invented Hall-current ion source with different approach for a form of reflector. In area under a conical anode 13 where a working gas is supplied through holes 17, on a top of reflector 15 there is installed a circular ring 44 made of a low sputtered non-magnetic material. It is installed into reflector 15 that has groove 45 for the ring 44. In this case, reflector 15 is not a plane disk as in regular end-Hall ion sources, but a reflector's central part has additional top 46. This top has a thickness over a regular reflector of about 3-5 mm. This extra thick reflector's part 46 is surrounded by a hollow cylinder-ring 44 of 10-15 mm in diameter, 5-7 mm in height and 1-1.5 mm thick that is useful at high discharge currents and voltages when ions produce high sputtering effect on reflector's central part 46. Extra reflector's thickness inside of this cylinder-divider 44 serves for increasing reflector's lifetime. An introduction of the reflector's ring 44 helps to divide working gas supplied an under anode area into several zones and helps to avoid gas discharge from a pinching that presents a problem in a regular end-Hall ion source.

Figure 8:
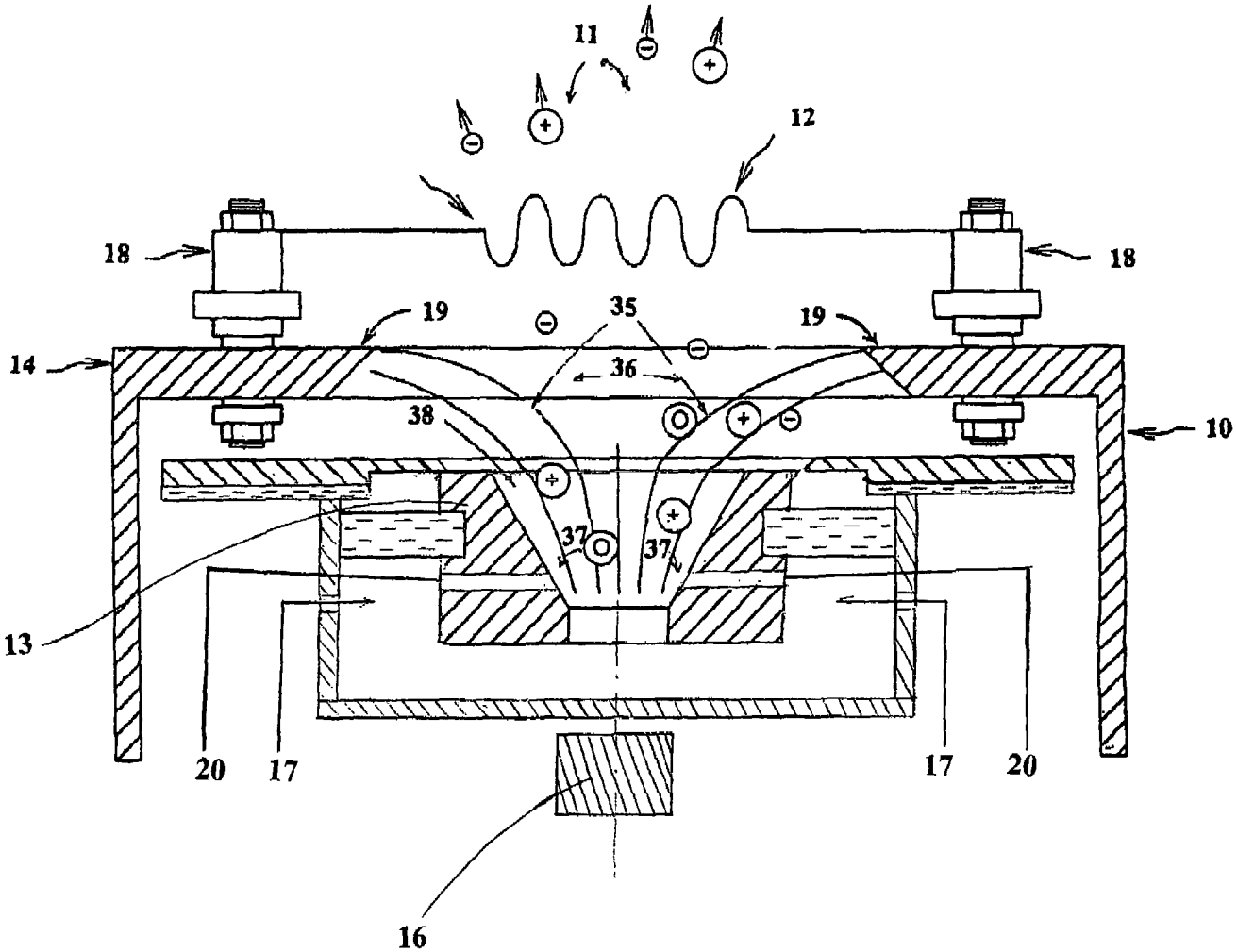
FIG. 8 presents a schematic drawing of the invented Hall-current ion source with alternative gas distributing system applying working gas through holes in anode and with gas distribution having a buffer chamber.

Present invention helps to reduce influence of film depositions from reactive gases on anode surface by utilizing another alternative version of a gas distribution system with working gas applied through holes in anode body as it is shown in FIG. 8. A series of holes in anode body makes possible to supply working gas directly into anode area, which is, in general, in Hall-current ion sources represents quite a large part of a discharge channel. The holes that shown in FIG. 8 are made with a recess inside of anode's body and contaminating anode oxides that are coming into anode from a vacuum chamber will be "not seeing" anode parts under a recess, because contaminating particles travel in vacuum of about $10^{-5}$-$10^{-4}$ Torr by direct lines with practically no collisions. Similar to a gas distributing system that is under anode area, in a buffer chamber is supplying provide gas flow into anode holes. These gas holes in anode body are directing working gas at a sharp angle to anode surface in a tangential direction and produce a vortex flow that provides uniform gas mixing in anode area. Experiments with holes utilized in anode body for working gas supply show that in environment with reactive gases discharge is observed in anode holes in a concentrated form and distributed over anode surface.

Due to the fact that in Hall-current ion sources magnetic field serves for keeping electrons from direct straight flight from cathode to anode area, so that electrons would have sufficient path and time for collisions with neutrals, the oscillations of current and voltage are playing very important role in such systems. In above mentioned article *"Physics of Closed Drift Thrusters"* by Zhurin et al in *Plasma Sources Science & Technology,* Vol. 8 (1999), beginning on page R1, and in a U.S. Pat. No. 7,116,054 "High-Efficient Ion Source with Improved Magnetic Field" by Zhurin there is presented quite a detailed information about various types of oscillations that take place during operation of Hall-current thrusters-ion sources.

It is necessary to note that some researchers consider oscillations as harmful feature of discharge that influence on behavior of ion beam, which is supposed to be just uniform current flow of ions of necessary energy (accompanied equal number of electrons) in certain area. Of course, it will be desirable to have such ion beams for interaction with targets, with thin film depositions as ion assist, for etching, etc. That is why all makers of ion sources have their ion sources with Power Supplies programmed in some specific modes, for example, providing Power Supplies with rigidly fixed constant output discharge voltage, or current value. Detailed studies show (see for example an above mentioned article "*Physics of Closed Drift Thrusters*" by Zhurin et al. in *Plasma Sources Science & Technology*, Vol. 8 (1999), beginning on page R1) that discharge in Hall-current ion sources with the increase of discharge voltages experiences high amplitude oscillations of both, discharge current and voltage parameters. Moreover, gas discharge at certain conditions can exist only with oscillations that actually help travel for electrons from cathode to anode area across magnetic field. In result, makers of Hall-current ion sources with Power Supplies do not provide the range of operating discharge voltages over 300 V. As it was discussed above, discharge voltage of 300 V is equivalent of only about 180 eV of mean ion beam energy in a Hall-current ion source. And for the optimum etching-deposition of most materials it is necessary to have ion beam energies in the range of 300-500 eV, or $V_d$=500-830 V.

Researchers working with closed drift thrusters that use regularly discharge voltages from 150 V (earlier models of SPT-50 and SPT-60) and up, in general use discharge voltages of 300-500 V (so-called thrusters with magnetic layer, such as SPT-100, which discussed in detail in above mentioned article "*Physics of Closed Drift Thrusters*" by Zhurin et. al.) or even higher 500-1000 V (anode layer and some magnetic layer thrusters of high power, also discussed in an article by Zhurin et al.) noticed that in order to have reliable operation of a thruster-ion source at high voltages it is necessary to provide a system: Power Supply—ion source with a connecting "filter" consisting of a capacitance-shunt in a discharge circuit that reduces amplitude of discharge voltage oscillations and stabilizes level of oscillations. Experiments show that this capacitance is necessary part for discharge voltage stabilization at significant values of discharge current oscillations. This value of a shunting capacitance can be estimated from the condition: $\tau_{filter}=RC\geqq T_d$, where $T_d$ is a characteristic value of the oscillation period, R and C are resistance and capacitance, $\tau$ is an RC circuit time. Assuming that an ion source during developed oscillations preserves Ohmic character of electrical load, it is possible to estimate value of an ion source resistance during oscillations, which will be equal approximately: $R_{osc}\sim\hat{U}_d/\hat{I}_d$, where $\hat{U}_d$ and $\hat{I}_d$ are discharge voltage and current amplitudes during developed oscillations.

For Hall-current ion sources with discharge currents of 5-10 A and with $V_d\approx$300-500 V (with a shunting capacitance), one can have that $R_d\sim$60-30 Ohm and 100-50 Ohm. For a typical period of current/voltage oscillations, which is about $T_d \approx 3\times10^{-5}$ sec, (this value is typically $(1\text{-}5)\times10^{-5}$ sec and depends on ion source dimensions and a kind of working gas utilized) one can obtain necessary value for a shunting capacitance: $C=T_d/R_d \approx (1\text{-}3)$ μF.

Figure 9:
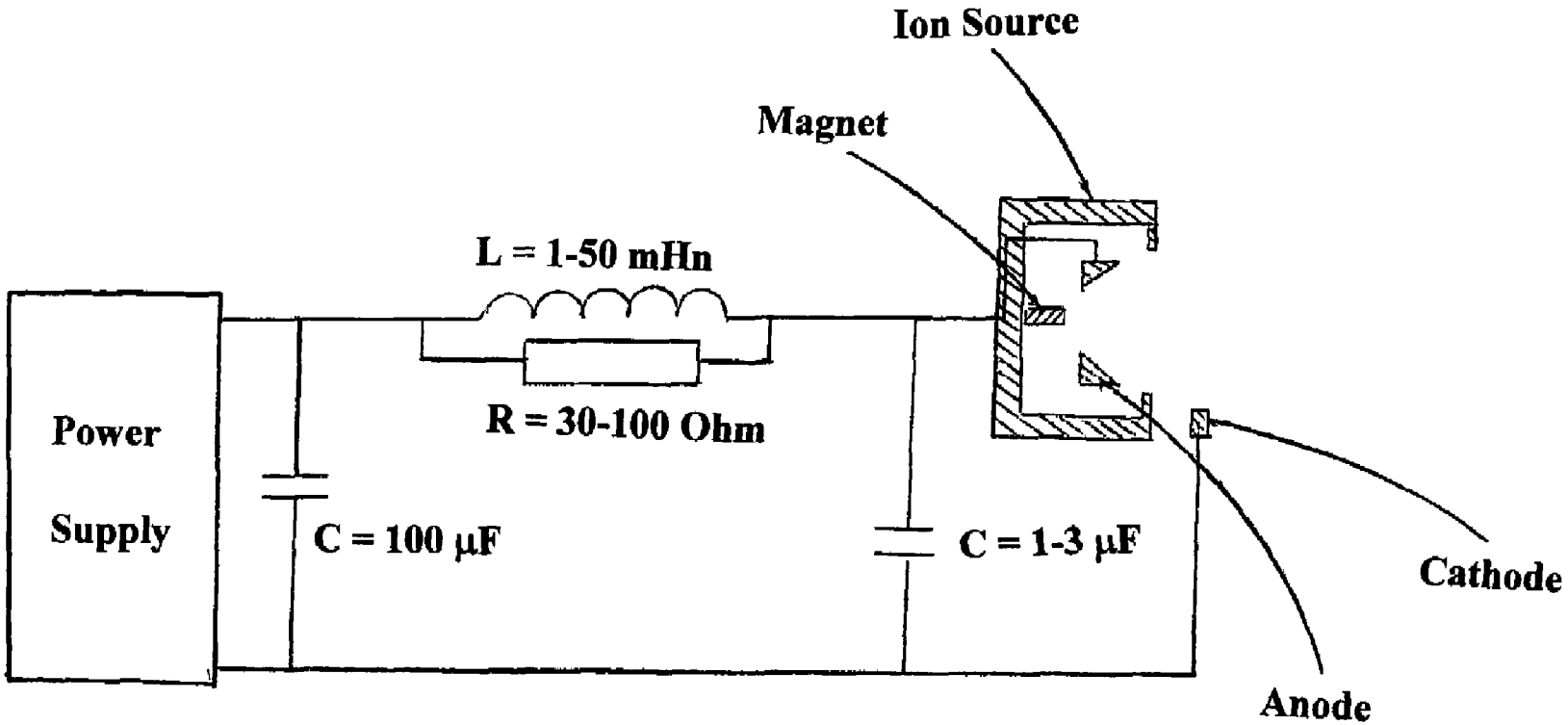
FIG. 9 presents an electrical schematic of the invented Hall-current ion source with the filtering scheme between a Power Supply and an ion source. Such a scheme provides extended range of operating discharge voltages, which are influenced by a presence of high amplitude "contour" and "ionization" type oscillations leading to discharge extinguishing at voltages over 300 V.

Together with a shunting capacitance it is advisable between capacitance and a Power Supply output voltage also to have an inductance that can limit current oscillations in a discharge circuit. In the case, if voltage oscillations are stabilized by a shunting capacitance with C≈1-3 μF with the voltage oscillation amplitude $\Delta V_d \leqq k_d \cdot V_d$, where the oscillation coefficient is selected as $k_d \approx 10^{-2}$, then an induction value can be estimated from the relationship: $L_o (dI/dt)_{max} \geqq k_d \cdot V_d$, or $L_o \Delta I_d \geqq k_d V_d \cdot T_d$, where $\Delta I_d$ is a permissible amplitude of current oscillations in a Power Supply. With $\Delta I_d=1$ A and $T_d=3\times10^{-5}$ sec, one can find an inductance for suppressing current oscillations: $L \geqq k_d V_d T_d/\Delta I_d \approx 9\times10^{-5}$ Hn. In practice selected values for the "filter" should be close to the calculated above and found experimentally for each particular setup of Power Supply and ion source. Such type of a circuit between a Power Supply and an ion source helps to have discharge voltages in the range of 300-700 V in a quite stable regime with discharge current and voltage oscillations that do not extinguish discharge. FIG. 9 shows electrical schematic for connection of a Hall-current ion source with a Power Supply with the filtering device that helps to extend range of discharge voltages over 300 V up to 1000 V.

Figure 10:
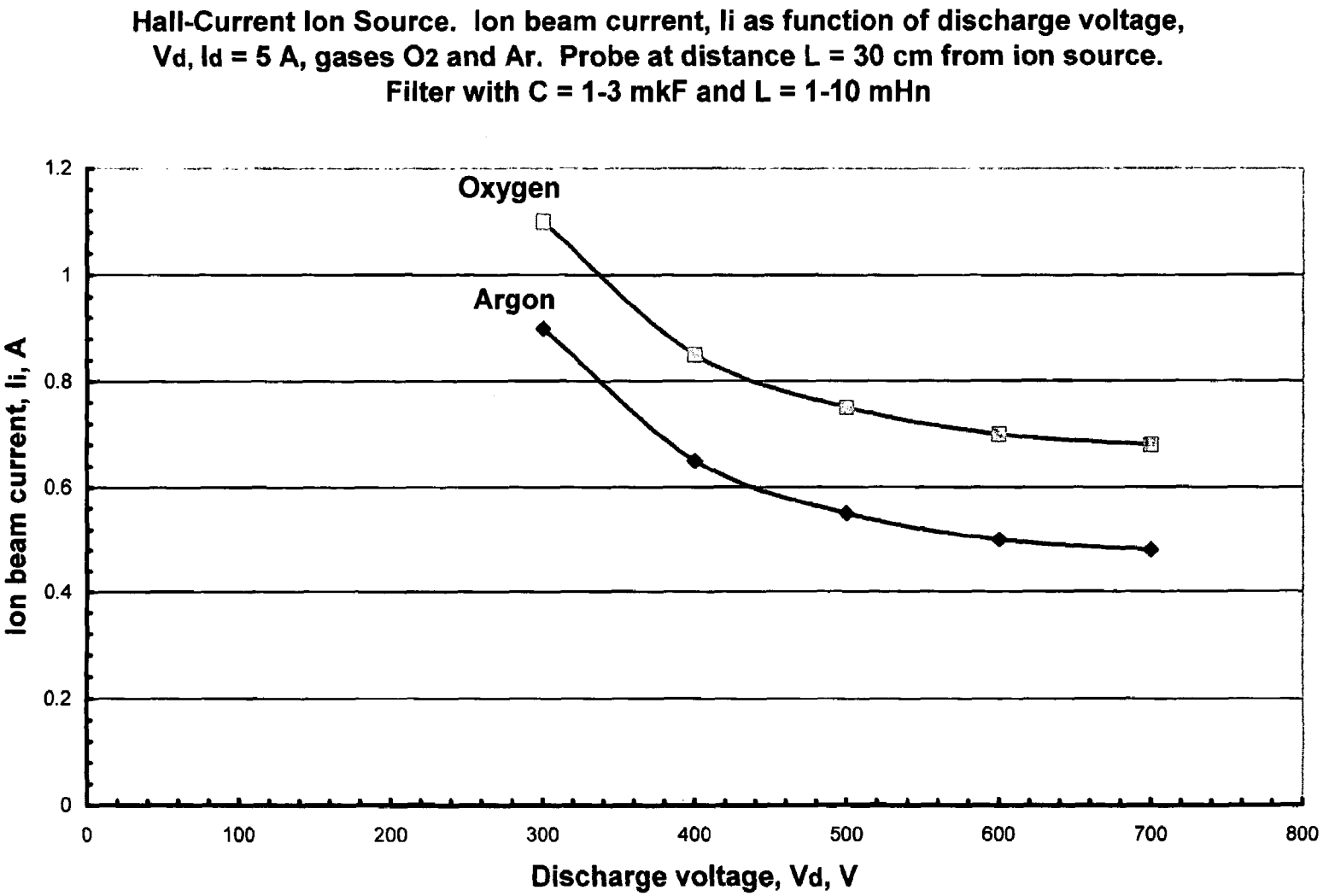
FIG. 10 presents experimental data for the invented Hall-current ion source using the filtering scheme between a Power Supply and the Hall-current ion source with suppression of large amplitudes voltage and current oscillations. These data show the ion beam current as a function of the discharge voltage for discharge voltages from 300 V to 700 V for two working gases: Oxygen and Argon.

FIG. 10 shows experimental results for the invented Hall-current ion source operating at discharge voltages at 300 V and up to 700 V utilizing an electrical filter between a Power Supply and the Hall-current ion source. The FIG. 10 presents ion beam current, $I_i$ as a function of discharge voltage, $V_d$; ion current measured at distance L=30 cm from ion source for two gases: Oxygen and Argon; discharge current, $I_d$=5 A, emission current, $I_{em}$=5.1 A. The electrical filter between a Power Supply and the invented Hall-current ion source has the following parameters: C=1-3 μF and L=1-50 mHn. Experiments showed that the Hall-current ion source operation is very stable with suppressed current and voltage oscillations.

While particular embodiments of the present invention have been shown and described, it will be evident to those skilled in the art that changes and modifications may be made without departing from the invention in its broadest aspects. Therefore, the aim in the appended claims is to cover all changes and modifications that are in the spirit and scope of what is patentable.

I claim:

1. A Hall-current ion source with electric potential impressed between a cathode and an anode in a discharge channel, where electrons move in an axial and radial magnetic field in a gas distributing system at a reflector and at an anode bottom part area and a maximum magnetic field in area of an ion source exit, where electrons move in partially closed drift trajectories, electrons collide with neutral particles and generate ions that are not influenced by magnetic field and move along axis to an ion source's exit producing a plasma flow consisting of ions and electrons; this ion source comprises of:

a gas distributing system placed under anode in a buffer chamber, where the buffer chamber dimensions are selected from the following relationships: $R_{buf}/R_{ch}$=1.3-1.5 and $L_{buf}/L_{ch}$=0.3-0.5;

said buffer chamber located under a hollow anode and this buffer chamber is connected with said gas distributing channel from a gas supply means;

a hollow cylinder of about 10-15 mm diameter, about 5-7 mm height and about 1-1.5 mm thick for separation of plasma areas;

said cylinder is placed at reflector's top under anode and reducing damage of said reflector;

said reflector's thickness in a hollow cathode dividing area is larger than in a regular reflector by about 2-5 mm to extend said reflector's lifetime;

a cathode-neutralizer placed outside a discharge channel exit;

said cathode is under a negative electrical potential, and said cathode produces electrons used for ionization of working gas during collisions with neutral molecules;

said cathode produces electrons for neutralization of an ion beam moving in an ion source discharge chamber and coming out of an ion source;

said cathode also provides necessary emission of electrons for purposes of maintaining discharge in conditions of a non-self-sustaining discharge for operation of such a discharge in a Hall-current ion source at low discharge voltages;

a discharge channel comprising mainly of a conical hollow anode that is under a positive electrical potential;

said anode having an opened exit side;

a magnetic means in a form of permanent magnet or electromagnet for establishing magnetic field necessary for magnetizing electrons and preventing them from motions by straight lines from the cathode-neutralizer to the anode and providing electron-atom collisions for ionizing working gas;

said magnetic means with variable magnetic field values for selection of necessary range of operating discharge voltages with low and high voltages that are equivalent of low and high ion beam energies for utilizing low magnetic field values in a reflector area of about 200-400 G with high electron emissions exceeding a discharge current value for obtaining low ion beam energies of about 10-25 eV for thin film depositions such as ion assisted deposition and a biased target deposition, where it is necessary to have low energy ion beams under a sputtering threshold, and utilizing high magnetic fields of over 400 G, and preferably, 1000-1500 G with regular electron emissions equal to discharge current for obtaining high energies of 300-500 eV for sputtering, or etching processes;

said low magnetic field values of about 200-400 G of permanent magnet, or electromagnet with high electron emission give a useful in practice dependence for Hall current ion sources at a non-self-sustained discharge modification of a discharge voltage, which is equivalent of ion beam energy, in the following form: $V_d \sim [k_1 B_z - k_2(I_{em} - I_d)] \cdot \dot{m}_a^{-1/2}$, where $V_d$ is discharge voltage, $I_d$ is discharge current, $I_{em}$ is electron emission current, $B_z$ is magnetic field on a top of reflector, $\dot{m}_a$ is an ion source mass flow, coefficients $k_1$ and $k_2$ depend on a sort of gas, its atomic mass and first ionization potential;

said low magnetic field values and said high electron emission currents provide the ion source with the higher values of ion beam current, $I_i$ in comparison with the ion beam current at approximately equal emission currents and discharge currents;

the magnetic means in the form of a permanent magnet, or electromagnet placed under a gas distributing system in a said ion source;

said permanent magnet is placed inside of a magnetically permeable shell that serves as a part of magnetic circuit;

said magnetically permeable shell in a form of a hollow cylinder made of two halves that are easy to separate during assembly-disassembly of said ion source for easy access to said permanent magnet for substitution of necessary value of said magnet for specific technological process requiring low, or high energy ion beam.

2. A Hall-current ion source according to claim 1, where working gas from a buffer chamber, as described in claim 1, but instead of supplying working gas under an anode area, working gas is applied through multiple holes through anode body with a recess in anode that working gas is applied at a sharp angle to anode body and directed tangentially with a gas vortex flow into an anode area providing uniformly distributed working gas into said anode area;

inside surface of said holes of the anode body serves as operating surface maintaining gas discharge of said anode in case of presence of dielectric film deposition on said anode surface;

said anode holes help to continue operation of said anode source with reactive gas.

3. A Hall-current ion source with an electrical filter between a Power Supply and a Hall-current ion source for suppression of large scale contour and ionization type oscillations of discharge current and voltage taking place in Hall-current ion sources at discharge voltages of 250 V and higher, up to 1000 V;

said electrical filter comprises of main elements that have been calculated and tested, such as a shunting capacitance of about 1-3 μF for suppression of high amplitude discharge voltage oscillations, permitting stable operation of Hall-current ion sources at discharge voltages of 250 V and higher, up to 1000 V;

said electrical filter also comprises an inductance of about 1-10 mHn and in parallel with an inductance a resistance of 30-100 Ohm for suppression of high amplitude discharge current oscillations, permitting stable operation of Hall-current ion sources at discharge currents of 1-10 A and higher, up to 30 A.

* * * * *